US011622588B2

(12) United States Patent
Grafenstein-Kinzel et al.

(10) Patent No.: US 11,622,588 B2
(45) Date of Patent: Apr. 11, 2023

(54) BELT WITH POCKETS CONCEALED BY FLAPS

(71) Applicants: Lora Jean Grafenstein-Kinzel, Minneapolis, MN (US); Micah Paul Grafenstein-Kinzel, Minneapolis, MN (US)

(72) Inventors: Lora Jean Grafenstein-Kinzel, Minneapolis, MN (US); Micah Paul Grafenstein-Kinzel, Minneapolis, MN (US)

( * ) Notice: Subject to any disclaimer, the term of this patent is extended or adjusted under 35 U.S.C. 154(b) by 0 days.

(21) Appl. No.: 14/932,750

(22) Filed: Nov. 4, 2015

(65) Prior Publication Data

US 2016/0120251 A1 May 5, 2016

Related U.S. Application Data

(60) Provisional application No. 62/075,187, filed on Nov. 4, 2014.

(51) Int. Cl.

| | |
|---|---|
| ***A41F 9/00*** | (2006.01) |
| ***A41D 27/20*** | (2006.01) |
| ***B25H 3/00*** | (2006.01) |

(52) U.S. Cl.

CPC ..... *A41F 9/002* (2013.01); *B25H 3/00* (2013.01); *A41D 27/201* (2013.01); *A41D 27/205* (2013.01)

(58) Field of Classification Search

CPC ..... A41F 9/002; A41D 27/201; A41D 27/205; A41D 27/20; B25H 3/00

USPC ..... 2/311, 312, 300

See application file for complete search history.

(56) References Cited

U.S. PATENT DOCUMENTS

| | | | | | |
|---|---|---|---|---|---|
| 1,478,497 | A * | 12/1923 | Winslow | A01K 97/06 | 224/683 |
| 1,558,228 | A * | 10/1925 | Botkin | A41F 9/002 | 2/102 |
| 1,606,667 | A * | 11/1926 | Rosenberg | A41F 9/002 | 224/236 |
| 1,629,404 | A * | 5/1927 | Mitchell | A41F 9/002 | 224/240 |
| 2,503,157 | A * | 4/1950 | Knee | A41F 9/002 | 2/238 |
| 2,766,459 | A * | 10/1956 | Stiglin | A41F 9/002 | 2/339 |
| 3,848,270 | A * | 11/1974 | Rand | A41F 9/002 | 2/311 |
| 4,322,024 | A * | 3/1982 | Kelly | A41F 9/002 | 224/235 |
| 4,513,455 | A * | 4/1985 | Gerhardt | A41D 27/20 | 2/253 |
| 4,579,265 | A * | 4/1986 | Schiller | A45C 1/04 | 224/222 |

(Continued)

*Primary Examiner* — Jocelyn Bravo

(74) *Attorney, Agent, or Firm* — Gutwein Law; Greg N. Geiser

(57) ABSTRACT

A belt for the placement and the concealing of items. The belt worn around the waist of a wearer and including a rear section and pair of front sections. The front sections including a pair of flaps. The flaps hingedly connected to the front sections and opening in a direction from the front of the belt to the rear of the belt. The flaps having an inner side and located adjacent to the exterior of the front sections. The flaps concealing the inner side and allowing for the placement of pockets and storage devices within this concealed area.

14 Claims, 8 Drawing Sheets

(56) References Cited

U.S. PATENT DOCUMENTS

| | | | | |
|---|---|---|---|---|
| 4,796,790 | A * | 1/1989 | Hamilton | A45C 11/00 206/438 |
| 4,819,846 | A * | 4/1989 | Hannemann | A45F 5/00 2/312 |
| 5,147,261 | A * | 9/1992 | Smith | A61F 5/028 2/338 |
| 5,484,395 | A * | 1/1996 | DeRoche | A61F 5/028 128/100.1 |
| 6,398,092 | B1 * | 6/2002 | Ansley | A45F 5/02 224/582 |
| 6,446,852 | B1 * | 9/2002 | Sorensen | A45F 3/14 224/236 |
| 6,913,176 | B1 * | 7/2005 | Buscemi | A45F 5/00 224/665 |
| 9,161,582 | B2 * | 10/2015 | Anderson | A41F 9/002 |
| 2007/0205235 | A1 * | 9/2007 | Knight | A45F 5/00 224/223 |
| 2007/0294807 | A1 * | 12/2007 | Van Cotthem | A41F 9/002 2/321 |
| 2011/0167540 | A1 * | 7/2011 | Little | A41F 9/002 2/312 |
| 2013/0117987 | A1 * | 5/2013 | Rienecker | A01K 27/006 29/428 |
| 2013/0174320 | A1 * | 7/2013 | Moye | A41D 20/00 2/170 |
| 2014/0115756 | A1 * | 5/2014 | Anderson | A41F 9/002 2/338 |

* cited by examiner

BELT WITH POCKETS CONCEALED BY FLAPS

CROSS REFERENCE TO RELATED APPLICATIONS

This application claims priority to U.S. Provisional Patent Application No. 62/075,187 filed 4 Nov. 2014 to the above named inventors, and is herein incorporated by reference in its entirety.

FEDERALLY SPONSORED RESEARCH OR DEVELOPMENT

Not Applicable

SEQUENCE LISTING, A TABLE, OR A COMPUTER PROGRAM

Not Applicable

BACKGROUND OF THE INVENTION

Often, tasks require an individual to carry on their person several items that are needed to complete the given task. Frequently, these items are specialized or numerous and cannot be easily carried or found. Still further, often items need to be found quickly and efficiently. One of these particular tasks is event planning and more specifically wedding planning. In the course of event planning an individual may be required to utilize several small and unrelated items to fix or mend a problem. One convenient way to carry all of these items is a belt. A typical utility belt is one particular item having multiple pockets and compartments in which these various items can be stored. These typical utility belts include functional pockets that are exposed. As appearance is important during a given event, it is essential that the apparel worn by the planner be fashionable and appropriate. Therefore, there is a need for a belt that offers both functional utility, ease of use and a desirable appearance. Preferably, this belt includes movable flaps to conceal stored items flush against an inner belt portion of the wearer and allow a user quick access to the stored contents.

SUMMARY OF THE INVENTION

Disclosed herein is a belt that can carry a large number of items that are concealed by movable flaps. The movable flaps conceal storage areas that are neatly organized and easily accessible while at the same time providing a fashionable aesthetic.

A belt having hidden storage is provided. The belt comprises an elongated strap having a fastener on a first end thereof. The first end retained to a second end. The second end and the first end defining a length of the elongated strap, wherein the strap can be adorned around the waist of a user. The belt includes one or more flaps secured to the belt by a fastener such as a hinge, wherein the flaps include pockets, hooks, and elastic bands thereon for storing various articles. The flaps can be secured flush against the belt so as to conceal the storage areas thereon, eliminating the need for pockets or pouches that hang down from the belt.

This invention uses a "flap system" which includes a flap and a fastener, such as a hinge. The flap system allows the user of this belt versus other belts to completely conceal the contents carried, carry multiple items as each flap adds additional surface area in which to attach items, pockets, hooks, etc., hold all items closer to the belt (and body) so that there is not a large "bulge" protruding from the belt from the carried items, and stay fashionable as all of the items are concealed without a bulky appearance.

BRIEF DESCRIPTION OF PRESENT INVENTION DRAWINGS

The accompanying drawings are included to provide a further understanding of the present invention and are incorporated in and constitute a part of this specification. The drawings illustrate exemplary embodiments of the present invention and together with the description serve to further explain the principles of the invention. Other aspects of the invention and the advantages of the invention will be better appreciated as they become better understood by reference to the Detailed Description when considered in conjunction with accompanying drawings, and wherein.

DETAILED DESCRIPTION OF THE PRESENT INVENTION

Figure 1:
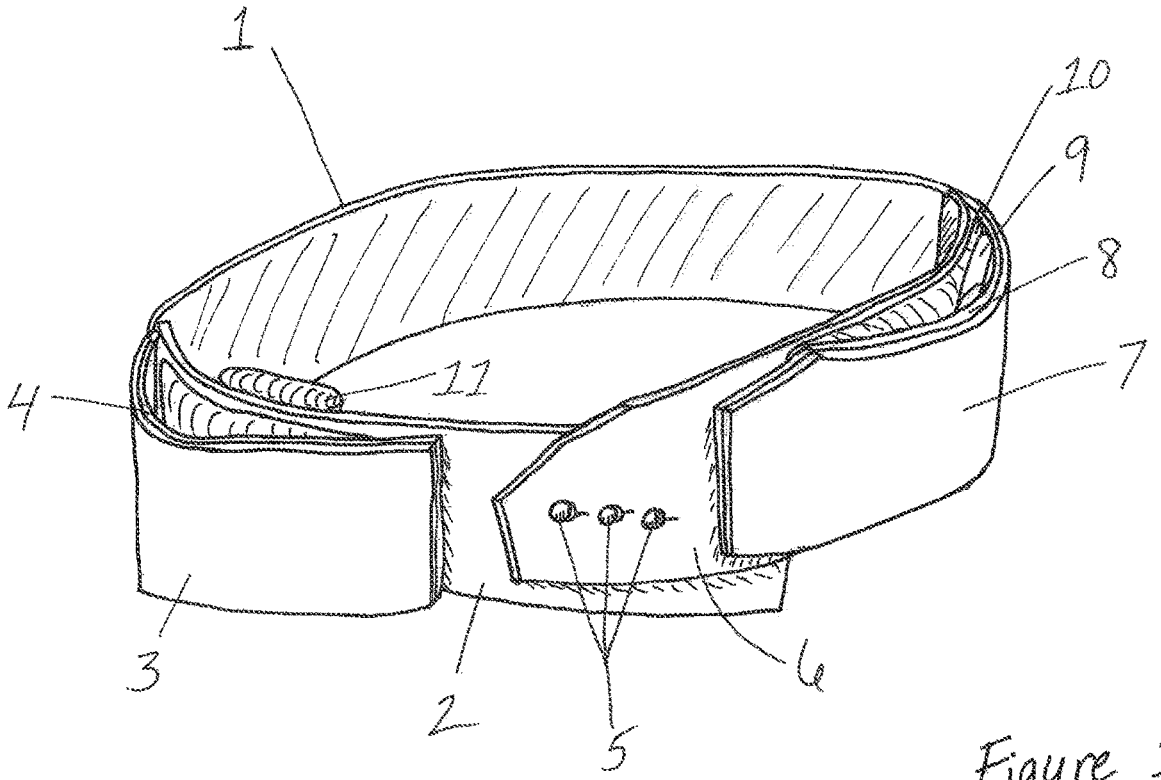
FIG. 1 is a perspective view of the present invention with the flaps closed, according to the present invention.

The following detailed description includes references to the accompanying drawings, which form a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure.

Referring now to FIGS. 1-8 of the belt with pockets concealed by flaps, according to the present invention. The belt is comprised of three inner portions representing the inner portions of the belt and defining a circumference for wearing on a waist of a user. The belt inner sections comprised of the rear section 1, first front side section 2, and second front side section 6. As shown in FIG. 1, the first front side section 2 is located on a right side of the belt from the perspective of a wearer and having an exterior side and a body side; the second front side section 6 is located on a left side of the belt from the perspective of a wearer and having an exterior side and a body side. The rear section 1 generally encompasses the back or rear of the wearer and can be sized according to the wearer, wherein a length of the rear section 1 can be configured to accommodate various waist sizes of a wearer. The rear section 1 is affixed on opposed sides to the first front section 2 and the second front side section 6.

A first flap 3 is hingedly connected to the first front side section 2 adjacent to the rear section 1, wherein the first flap 3 articulates directionally from the front of the wearer's body to the rear of the wearer's body. The first flap 3 has an outer side and an inner side 4. The inner side 4 adjacent to the exterior side of the first front side section 2. In the preferred embodiment of the present invention, the first flap 3 is comprised of two separate pieces of material joined with an adhesive. Accordingly, these pieces of material are similarly sized and intended to appear as one singular unit. This configuration is utilized to aid in the construction of the belt and wherein the composition of two pieces of materials allows for the placement of a hinge member 16 and a plurality of rivets 15 for a durable and resilient construction composition of the belt.

A second flap 7 is hingedly connected to the second front side section 6 adjacent to the rear section 1, wherein the second flap 7 articulates directionally from the front of the wearer's body to the rear of the wearer's body. The second flap 7 has an outer side and an inner side 8. The inner side 8 adjacent to the exterior side of the second front side section 6. In the preferred embodiment of the present invention, the second flap 7 is comprised of two separate pieces of material joined with an adhesive. Accordingly, these pieces of material are similarly sized and intended to appear as one singular unit. This configuration is utilized to aid in the construction of the belt and wherein the composition of two pieces of materials allows for the placement of a hinge member 16 and a plurality of rivets 15 for a durable and resilient construction composition of the belt.

In the preferred embodiment of the present invention, the first flap 3 and the second flap 7 have an exterior surface that is unadorned and constructed out of a leather or leather-like material. Although this is preferred, alternately, the exterior surface could be adorned with jewels, stamps, stitching, lace, patterns, conches, or customized to meet a wear's preferences.

The first front section 2 and the second front section 6 are removably joined at their ends opposed to the rear section 1 to complete the circumference of the belt when worn on the waist of the wearer. The first front section 2 and the second front section 6 are securely adjoined via a fastener 5 which can be received within an aperture and wherein the size of the circumference of the belt can be adjusted via this fastener 5 communication. In the preferred embodiment of the present invention, the fastener 5 is a ball fastener received within an aperture or a buckle that allows the wearer to easily remove and put on the belt. Although, a ball fastener 5 is the preferred fastener, alternate fasteners may be used such as snaps, clasps, or other similar fasteners.

Figure 2:
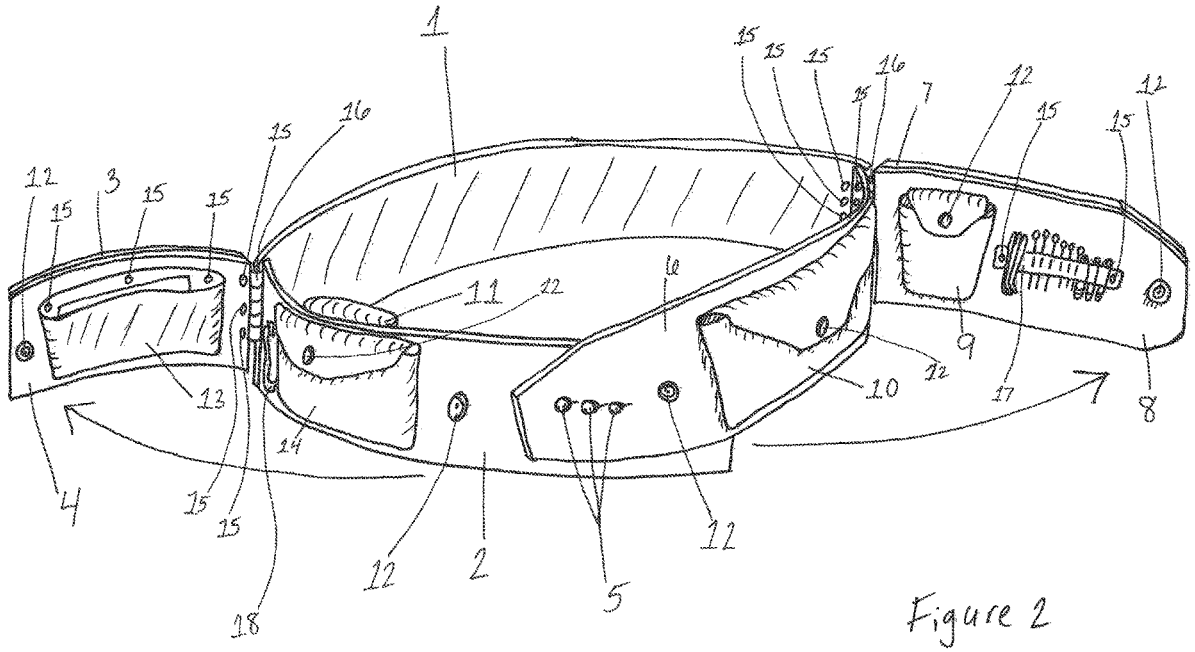
FIG. 2 is the front perspective view of the present invention with both the left and right flaps open, according to the present invention.
Figure 3:
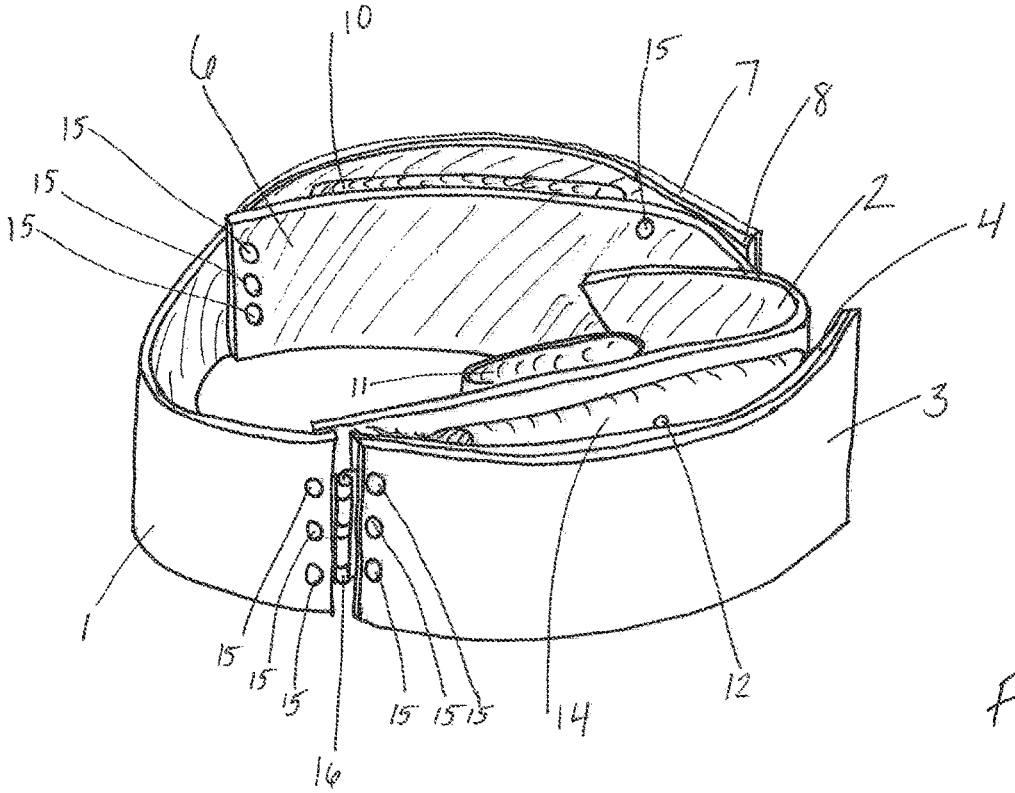
FIG. 3 is the perspective view of the right side of the present invention with both flaps closed, according to the present invention.

Referring now specifically to FIG. 2, the belt is shown with the first flap 3 and the second flap 7 in an open position. As is indicated by the arrows, the first flap 3 and the second flap 7 open in a direction from the front of the belt towards the rear of belt. This opening direction and configuration allows the wearer to easily access contents concealed by the first flap 3 and second flap 7. Both the first flap 3 inner side 4 and second flap 7 inner side 8 and the exterior side of the first front side section 2 and the exterior side of the second front side section 6 provide a surface for the placement of articles and retained within pockets 9, 10, 13, 14, hooks, loops, carabiners 18, and elastic bands 17. The pockets 9, 10 and 14 are shown as including an enclosure secured with a snap 12 or being open 13. The elastic band 17 allows for the retaining of items such as bobby pins, safety pins, or floral pins. An additional elastic band 11 may be located on an interior of the first front side section 2 or second front side section 6 to retain a cell phone or other similar electronic device close to the body of the wearer.

Figure 4:
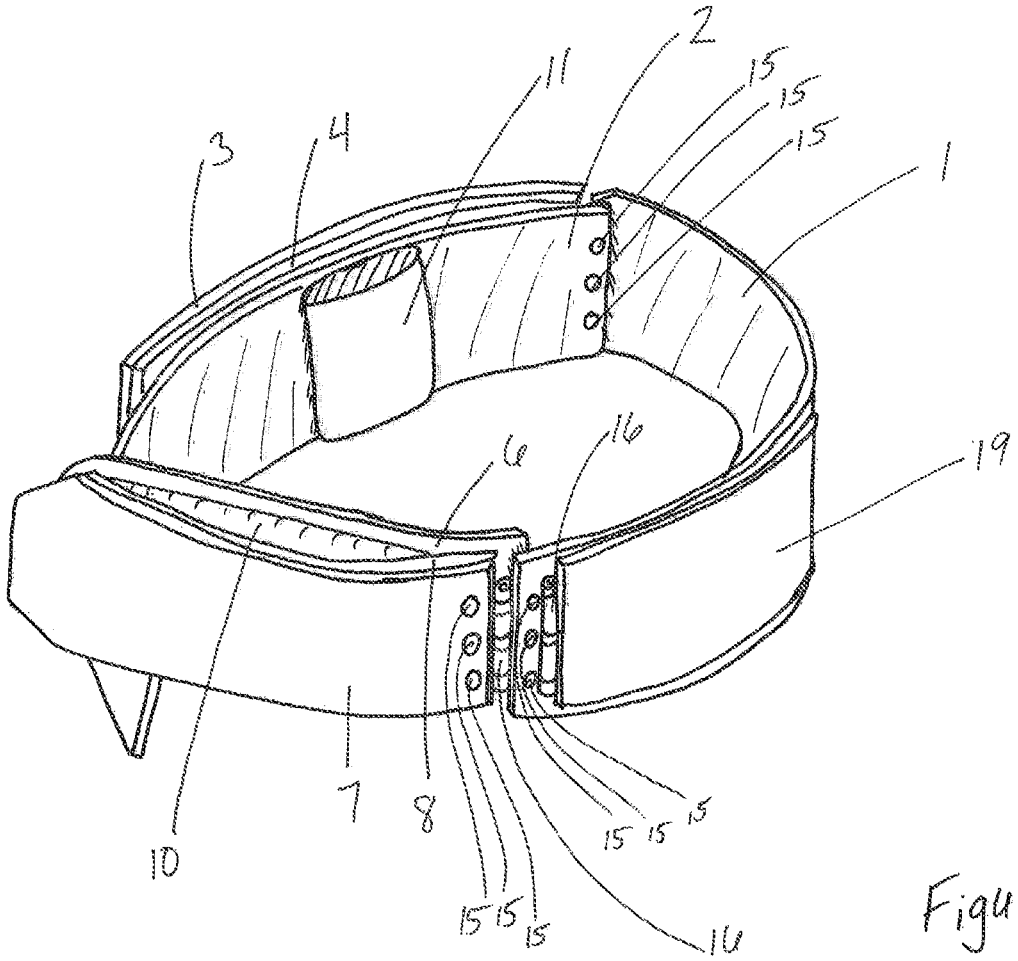
FIG. 4 is the perspective view of the left side of the present invention with both flaps closed, according to the present invention.
Figure 5:
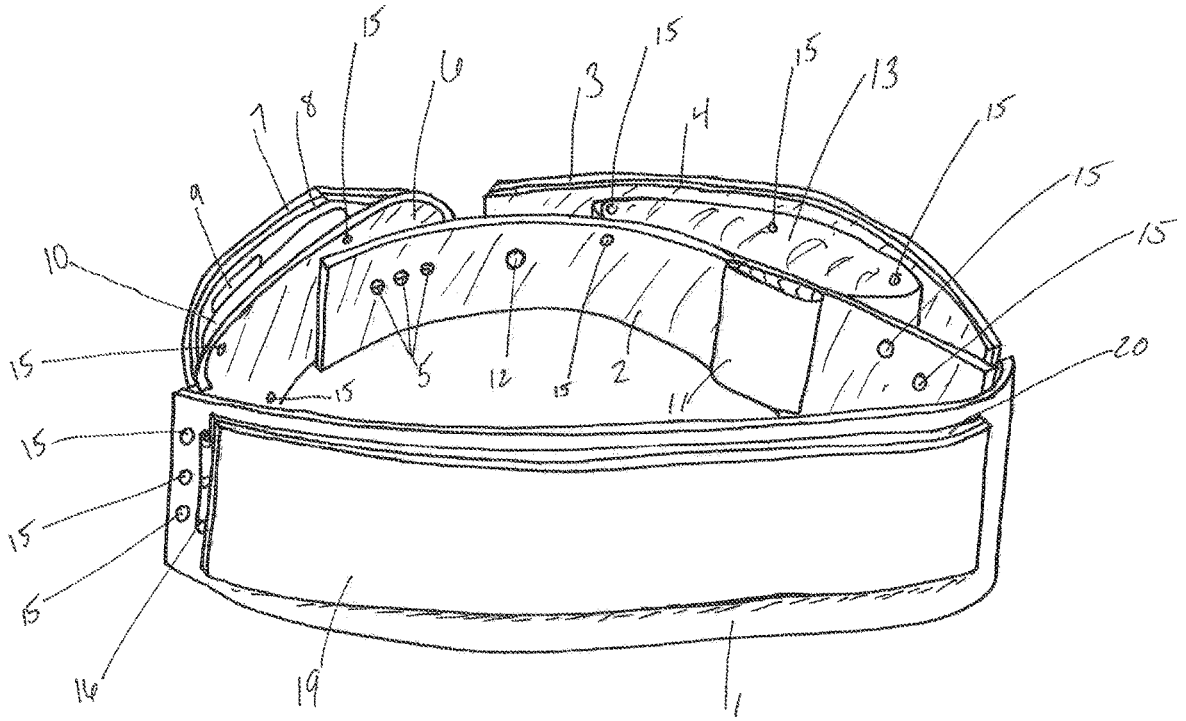
FIG. 5 is the rear perspective view of the present invention with the rear flap closed, according to the present invention.
Figure 6:
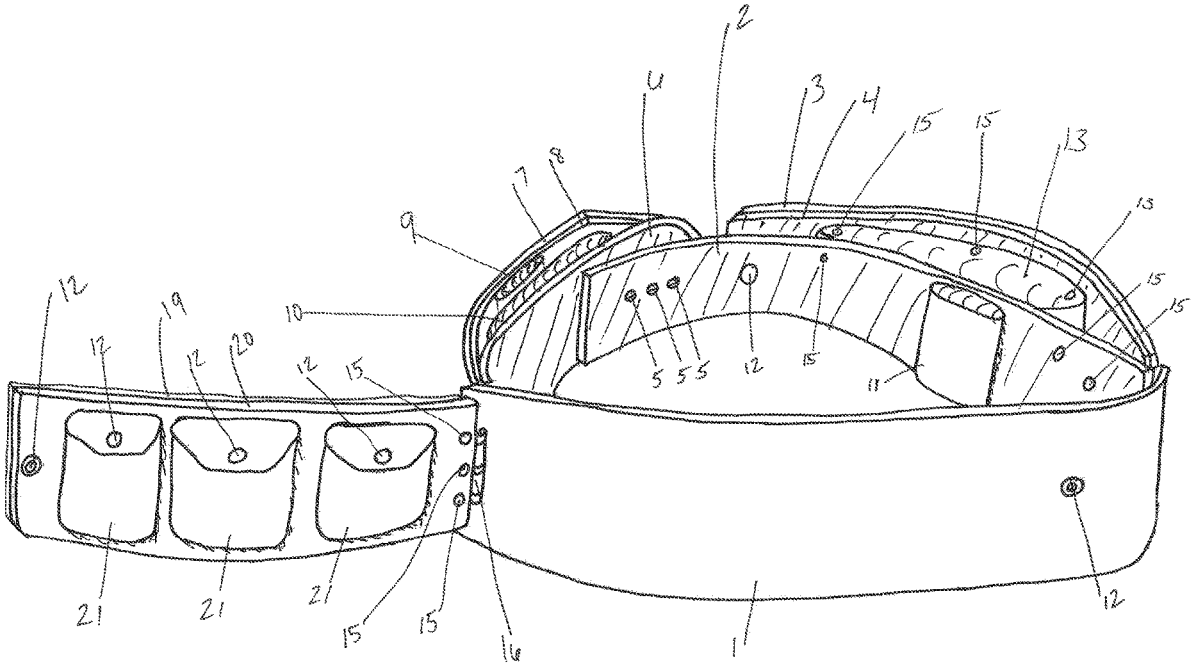
FIG. 6 is the rear perspective view of the present invention with the rear flap open, according to the present invention.
Figure 7:
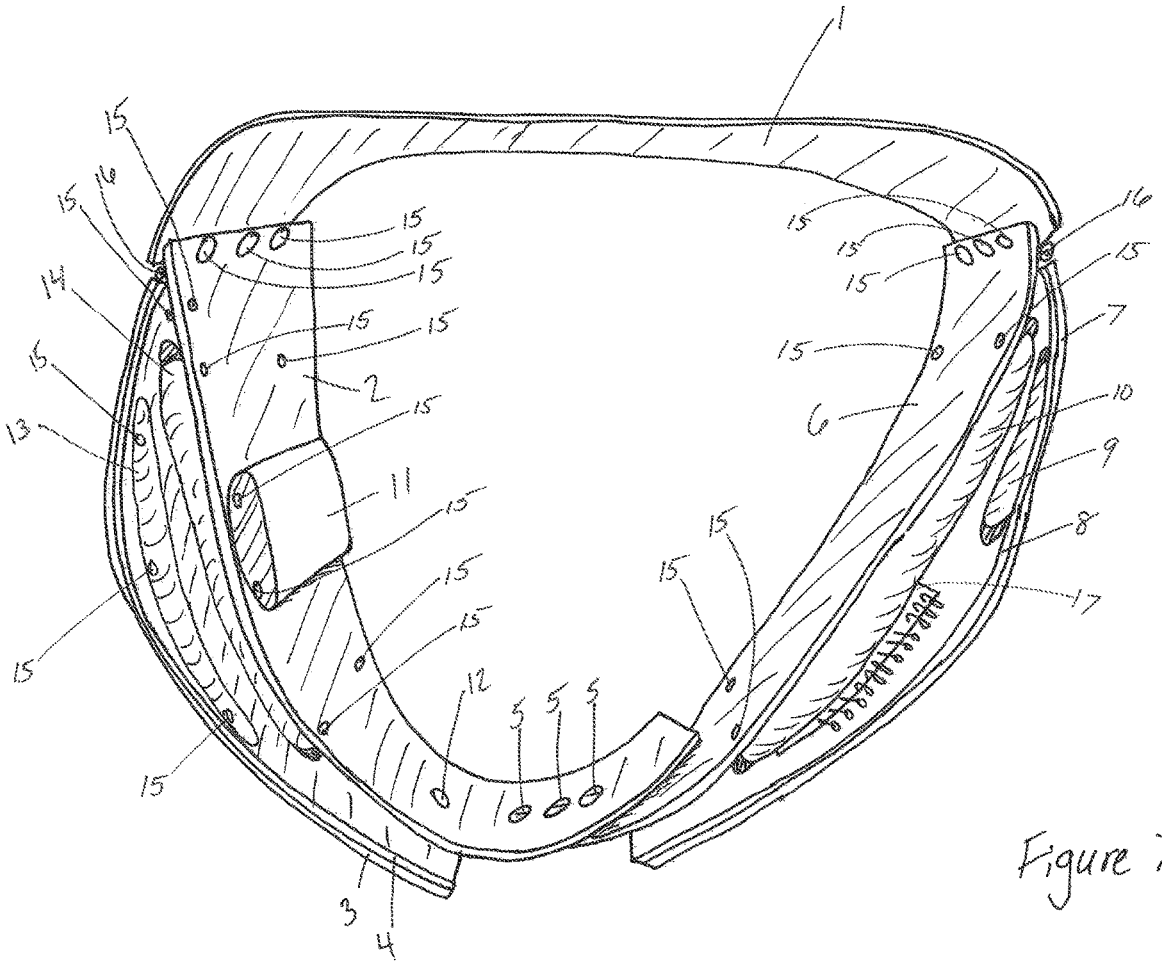
FIG. 7 is the top down elevation view of the present invention, according to the present invention.
Figure 8:
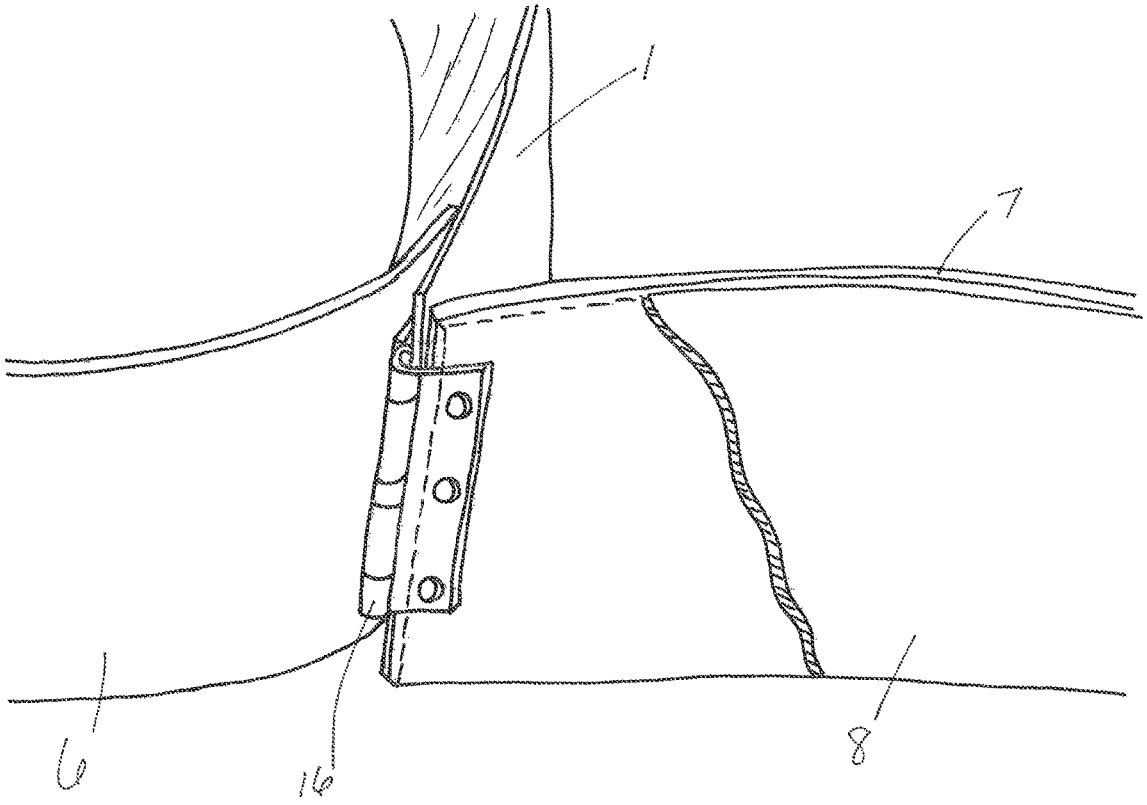
FIG. 8 is a broken away view of how the flap is connected to the side sections by the fastener with the outside flap removed from view, according to the present invention.

Referring now to FIGS. 4-6, the belt is shown with a rear flap 19. The rear flap 19 is hingedly connected at an end to the rear section 1 adjacent to either the first front side section 2 or the second front side section 6, wherein the rear flap 19 articulates outward from the wearer's body. The rear flap 19 has an outer side and an inner side 20. The inner side 20 adjacent to the exterior side of the rear section 1. In the preferred embodiment of the present invention, the rear flap 19 is comprised of two separate pieces of material joined with an adhesive. Accordingly, these pieces of material are similarly sized and intended to appear as one singular unit. This configuration is utilized to aid in the construction of the belt and wherein the composition of two pieces of materials allows for the placement of a hinge member 16 and a plurality of rivets 15 for a durable and resilient construction composition of the belt. The inner side 20 of the rear flap 19 provides a surface for the placement of additional pockets 21. The pockets 21 may be enclosed with a snap 12.

In the preferred embodiment of the present invention, the various sectional components of the belt are adjoined with rivets 15. Additionally, the various flap elements are formed from an adherence of two similarly sized sections in a sandwich configuration. This configuration allows for the placement of hinge elements 16 between the two sections. The preferred closure of the various flap elements is a snap fastener 12. This style fastener allows for quick and easy access and is reliable and durable.

In an alternate embodiment, the rear section 1 includes portions or gussets of extensible material such as elastic to allow for extension of the rear section 1. Accordingly, the gussets allow for slight adjustments to the size of the belt without additional adjustments to the belt size. Additionally, the rear section can be comprised of a flexible or extensible material. This gusseted construction may be utilized in other sections and the flaps of the belt to allow for slight adjustments to the size and extension of the flaps and belt sections.

The hinge 16 can be comprised of alternate materials or structures; an alternate embodiment utilizes a direct connection of the flaps to the sections directly with rivets 15. Such an alteration would not alter the nature or function of the invention. Another alternate embodiment would be to use other materials for the belt and flaps other than leather. The preferred use is leather but other materials such as plastic or elastics could be used. Another alternate embodiment would be the use of clear pockets with a clear flap or clear open pocket. The intended use of a clear pocket versus a leather pocket would be for easy content visibility when the flaps are opened. This would be ideal in high security areas such as a sports or event stadium, fair grounds, security building, or event with a large gathering of people being searched at a security point.

While the invention has been described with reference to an exemplary embodiment(s), it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment(s) but that the invention will include all embodiments falling with the scope of the claims.

What is claimed is:

1. A belt, the belt adapted to be worn around a waist of a wearer, the belt comprising:

a first end;

a second end, the second end opposite the first end, a distance between the first end and the second end defining a circumference of the belt;

a fastener, the fastener removably securing the first end to the second end, the fastener allowing the belt to be secured for the securing of the belt to the wearer; and a first flap, the first flap comprised of a first separate material and a second separate material, wherein the first separate material and the second separate material are joined together to form a cohesive structure, the first flap including a first hinge member, the hinge member positioned between the first separate material and the second separate material, wherein the first hinge member is received on an exterior side of the belt adjacent to a rear portion of the belt, wherein the first hinge member is located at and defines a first hinge axis that is perpendicular to a longitudinal axis of the belt, wherein the first flap is configured to rotate about the first hinge axis from a closed position to an open position, wherein an interior of the first flap is configured to face a front portion of the wearer when the first flap is in the closed position, the first flap concealing a first plurality of pockets, the first plurality of pockets affixed to both the exterior side of the belt and the interior of the first flap, the first flap secured to the belt exterior in the closed position.

2. A belt as in claim 1, wherein the belt includes a second flap, the second flap comprised of a first separate material and a second separate material, wherein the first separate material and the second separate material are joined together to form a cohesive structure, the second flap including a second hinge member, the second hinge member positioned between the first separate material and the second separate material, wherein the second hinge member is received on the exterior side of the belt adjacent to the rear portion, wherein the second hinge member is located at and defines a second hinge axis that is perpendicular to the longitudinal axis of the belt, wherein the second flap is configured to rotate about the second hinge axis, from a closed position to an open position, wherein an interior of the second flap is configured to face the front portion of the wearer when the second flap is in the closed position, the second flap concealing a second plurality of pockets, the second plurality of pockets affixed to both the exterior side of the belt and the interior of the second flap, the second flap secured to the belt in the closed position.

3. A belt as in claim 2, wherein the belt includes a rear flap, the rear flap hingedly received on the belt and positioned between the first flap and the second flap and movable from a closed position to an open position, the rear flap concealing a third plurality of pockets, the third pockets affixed to an interior of the rear flap, the rear flap secured to the belt in the closed position.

4. A belt as in claim 1 wherein the belt is extensible.

5. A belt as in claim 1 wherein the belt is constructed primarily of leather.

6. A belt as in claim 1 wherein an interior of the belt includes a pocket for an electronic device.

7. A belt, the belt adapted to be worn around a waist of a wearer, the belt comprising:

a rear section having a first end and a second end opposite to the first end;

a first front side section having an exterior side, the first front side section affixed to the first end of the rear section;

a second front side section having an exterior side, the second front side section affixed to the second end of the rear section opposed to the first front side section, the first front side section and the second front side section removably joined together at a front end of each of the first and the second front side sections, opposite the rear section;

a first flap, the first flap comprised of a first separate material and a second separate material, wherein the first separate material and the second separate material are joined together to form a cohesive structure, the first flap including a first hinge member, the first hinge member positioned between the first separate material and the second separate material, wherein the first hinge member is connected to the exterior side of the first front side section adjacent to the first end of the rear section, wherein the first flap is configured to rotate about a first hinge axis that is perpendicular to a longitudinal axis of the belt, the first flap having an outer side and an inner side, the inner side adjacent to the exterior side of the first front side section, the first flap concealing an area of the first front side section on the exterior side of the first front side section, the concealed area and the inner side of the first flap including a first plurality of pockets, the first flap secured to the first front side section in a closed position, wherein the inner side of the first flap is configured to face a front portion of the wearer when the first flap is in the closed position; and a second flap, the second flap comprised of a first separate material and a second separate material, wherein the first separate material and the second separate material are joined together to form a cohesive structure, the second flap including a second hinge member, the second hinge member positioned between the first separate material and the second separate material, wherein the second hinge member is connected to the exterior side of the second front side section adjacent to the second end of the rear section, wherein the second flap is configured to rotate about a second hinge axis that is perpendicular to the longitudinal axis of the belt, the second flap having an outer side and an inner side, the inner side adjacent to the exterior side of the second front side section, the second flap concealing an area of the second front side section on the exterior side, the concealed area and the inner side of the second flap including a second plurality of pockets, the second flap secured to the second front side in a closed position, wherein the inner side of the second flap is configured to face the front portion of the wearer when the second flap is in the closed position.

8. A belt as in claim 7, wherein the rear section includes a rear flap, the rear flap hingedly connected at the first end of the rear section or the second end of the rear section, the rear flap having an outer side and an inner side, the rear flap movable from an open position to a closed position, the inner side including a third plurality of pockets, the rear flap secured to the rear section when in the closed position.

9. A belt as in claim 7, wherein the rear section is extensible.

10. A belt as in claim 7, wherein the belt is constructed out of leather.

11. A belt as in claim 7, wherein the area concealed by the first flap or the area concealed by the second flap includes a carabiner.

12. A belt as in claim 7, wherein the area concealed by the first flap or the area concealed by the second flap includes an elastic strap, the elastic strap providing an attachment means for pins.

13. A belt as in claim 7, wherein an interior of the belt includes a pocket for an electronic device.

14. A belt as in claim 7, wherein the first flap and the second flap are each secured to the belt with a respective snap when in the closed position.

* * * * *